United States Patent [19]

Satpathy

[11] Patent Number: 5,033,699

[45] Date of Patent: Jul. 23, 1991

[54] METHOD AND SYSTEM FOR FLYING KITES

[76] Inventor: Basant K. Satpathy, 4817 S. 102nd St., Omaha, Nebr. 68127

[21] Appl. No.: 496,652

[22] Filed: Mar. 21, 1990

[51] Int. Cl.[5] ..... B64C 31/06

[52] U.S. Cl. ..... 244/155 A; 242/96

[58] Field of Search ..... 244/153 R, 155 R, 155 A, 244/153 A; 242/96, 99

[56] References Cited

U.S. PATENT DOCUMENTS

| | | | |
|---|---|---|---|
| D. 165,269 | 11/1951 | Cordell . | |
| 274,490 | 3/1883 | Gunn . | |
| 2,475,656 | 7/1949 | Bidak | 242/96 |
| 3,138,356 | 6/1964 | McClain . | |
| 3,652,027 | 3/1972 | Wong . | |
| 3,738,589 | 6/1973 | Brayman | 242/96 |
| 4,014,477 | 3/1977 | Hyun . | |
| 4,153,222 | 5/1979 | Than | 242/96 |
| 4,176,806 | 12/1979 | Kwon . | |
| 4,176,807 | 12/1979 | Kwon . | |
| 4,714,217 | 12/1987 | Prentice . | |

*Primary Examiner*—Galen Barefoot
*Attorney, Agent, or Firm*—James D. Welch

[57] ABSTRACT

A system for use in flying kites and the method of its use are disclosed. The system comprises an elongated tapered rod to which are attached two relatively large diameter round disks. A multiplicity of small constant diameter rods are attached to and between the relatively large diameter round disks by way of small holes in the relatively large diameter disks, to form an open cylindrical reel onto, or from, which kite string can be wound or unwound. The method of use of the system provides that a user form closed areas with each hand between the thumb and first finger of each hand, then loosely place one end of the tapered elongated rod into one such closed area, and the other end of the elongated tapered rod loosely into the other such closed area. The method of use then provides that the user perform large circular motions with his or her hands, each hand moving approximately 180 degress out of phase with the other hand. Said motion by a user causes string to be wound quickly onto the open cylindrical reel, or off thereof, depending on the direction of rotation and the direction the string was wound onto the open cylindrical reel in the first instance. In combination with the use of a weight placed onto a kite so that the kite naturally assumes a tilted position in an unperturbed constant wind situation, and with varying user applied string tensions, a user can not only launch the kite in a small area and in low wind, but can also precisely control the motion of a launched kite in flight.

2 Claims, 1 Drawing Sheet

METHOD AND SYSTEM FOR FLYING KITES

TECHNICAL FIELD

The present invention relates to kite more particularly to a system for kite string winding and unwinding and a method of kite launching and launched flying kite motion control which utilizes the system.

BACKGROUND

The sport of kite flying has been known for thousands of years. It has been popular in the United States for hundreds of years and in recent years the sport has gained in popularity amongst educated adults. Over the years various inventors have developed aids to enhance the ease and precision with which one can practice the sport. As early as 1883 a Gunn U.S. Pat. No. 274,490 taught a simple system for winding string which comprised a simple twisted wire frame with a reel mounted therein. The invention included means for grasping the frame with one hand and for rotating the reel with the other. In 1964, McClain U.S. Pat. No. 3,138,356 taught a kite control means involving the use of two strings. Said strings were taught as attached to the opposite ends of the cross brace of a kite and as being brought to a single rod upon which the strings could be wound. In use the kite motion was controlled by varying the tension in the strings separately. In 1972 Wong U.S. Pat. No. 3,652,027 taught a string winding means which included ratched teeth in combination with a handle and a rotatable reel. The invention allows free reel rotation operation, a locked reel position and a user controlled bracking mode of operation. In 1977 Hyun U.S. Pat. No. 4,014,477 taught a kite reel which comprised a centrally located elongated handle to which, at one end thereof, is attached a large diameter spool. The large diameter spool has provision thereon for a user to grasp with one hand, while the other hand grasps the elongated handle. By rotating the hand which grasped the spool one could cause the spool to rotate around the elongated handle and thereby wind string onto said spool. In 1979 Kwon U.S. Pat. No. 4,176,806 taught a system similar in appearance to that taught by Hyun, but which included a clutch mechanism in the spool or reel. Kwon taught that one could grasp the elongated handle at one end of the reel and let the reel spin when letting string unwind from the reel as a kit tugged thereon. Another patent to Kwon, U.S. Pat. No. 4,176,807 also issued in 1979. That Patent taught a three part handle with an axle affixed at right angles to the portion of the three part handle which a user grasps with one hand during use. On the axle is located a reel which has provision for providing rotation thereto by a user's second hand. A releasable clutch mechanism is also taught as being present at the interconnection of the three part handle and the reel. In a 1987 Prentice U.S. Pat. No. 4,714,217 there is taught a variation on the two string kite control system of McCain. The string winding means in Prentice, however, is separable into two parts. The two parts can be combined to allow string to be wound thereon when desired.

The above summary of prior patents shows that numerous prior Patents have issued for kite flying systems. The use of various designs for and combinations of handles, string reels or spools, ratchets, clutch mechanisms, the number of strings used etc. have provided users with varying and different degrees of capability and ease of use.

The area is seen to be one in which continued interest exists, and in which a need exists for continued advancement.

DISCLOSURE OF THE INVENTION

The present invention provides a relatively simple, but very efficient, system for use in the winding and unwinding of kite string. The present invention system is also designed to allow very easy and economical construction. The present disclosure teaches a method of use of the system which provides a user a great amount of control over the launching of, and over the motion of kites after they have been launched.

The system of the present invention comprises an elongated tapered rod over which are placed, from the small diameter side, two relatively large diameter round disks, which relatively large diameter round disks have different diameter small holes in the centers thereof. The small diameter holes in the centers of the relatively large diameter round disks are sized so that the relatively larger diameter round disks come to rest firmly at specific locations on the elongated tapered rod when they are slid thereon from the small diameter side of the elongated tapered rod. The system of the present invention also comprises a multiplicity of small constant diameter rods which small constant diameter rods extend between, and attach to, the relatively large diameter round disks, in small holes therein, when the relatively large diameter round disks are in place on the elongated tapered rod. The small holes are located on circular loci on the relatively large diameter disks, at radii locations from the center of said relatively large diameter round disks which are, of course, less than the full length radii of the relatively large diameter round disks. The small constant diameter rods are, it can be visualized, caused to be secured between the two relatively large diameter disks in a manner such that the small constant diameter rods are parallel to one another and such that an open cylindrical reel is formed by the outer aspects of the mounted small constant diameter rods, onto which kite string can be wound and from which kite string can be unwound.

The method of use of the so constructed system provides that a user form enclosed areas between the thumb and first finger of each hand. The user than must loosely place one end of the elongated tapered rod into the enclosed area of one hand, and the opposite end of the elongated tapered rod loosely into the enclosed area of the other hand. A long string must then be secured to the open cylindrical reel at one end and to a kite at the other. A majority of said string should be wound onto the open cylindrical reel at the start of practice of the method. A user can then unwind a short length of the string to which the kite is attached, and then move his or her hands in large circular motions, which are approximately 180 degrees out of phase with one another, so that the elongated tapered rod is caused to rotate, and with it the open cylindrical reel. It will be appreciated that the rotation of the elongated tapered rod will be amplified by the larger diameter of the open cylindrical reel, and, hence, a large amount of string can be easily caused to wind upon the open cylindrical reel quickly by the user motion described. The result is that a tension is placed on the string, and the attached kite is caused to rise into the air. By a series of such string winding actions, interspersed with unwinding opposite rotation actions by a user, a kite can be launched in a small space and in low wind conditions. This eliminates the common requirement that to launch a kite one have a large area available in which to run with the kite string in one's hand, and a reasonably strong wind available. One can, with the present invention, stand in one position and launch a kite.

It will also be appreciated that the construction of the open cylindrical reel allows air to pass there-through. Should string become wet, the air passing through will have a tendency to dry it while it is on the open cylindrical reel.

Another element of the method of use of the system involves the placement of a small weight on a kite so that in unperturbed constant wind situations the kite does not assume a vertical orientation. That is, the kite will tend to tilt in a direction caused by the presence of the weight. It has been found that in such a state, a launched kite can be made to "rock" by application of a sudden jerk or tug on the string. Such a sudden jerk or tug can be easily applied by a user of the present invention system by a quick winding motion as has been already described. If one then, at some point in the kite rocking motion, again provides a firm constant tension to the string by performing a constant string winding action, it has been found that the kite will move in the direction in which the kite was pointed at the time the firm constant string tension was again initiated. The kite will, within natural limits, continue to move in the identified direction until the firm constant tension is released. One can then again apply another sudden jerk or tug, thereby causing the kite to again rock, and proceed to then again apply a firm constant tension to the string when the kite is pointing in a different direction and thereby cause the kite to move in another direction. Between kite movement exercises, as just described, one might cause the kite to rise to a higher altitude by a sequence of actions similar to those involved in launching the kite, so that the string winding necessary to produce a firm constant string tension, as described, will not bring the kite to a lower than desired altitude.

The system and method of use of the present invention are more precisely described and depicted in figures in the Detailed Description Section.

BRIEF DESCRIPTION OF THE DRAWINGS

FIG. 3A shows a kite without a tilt causing weight attached to the kite. FIG. 3B shows a kite with a tilt causing weight attached thereto.

DETAILED DESCRIPTION

Figure 1:
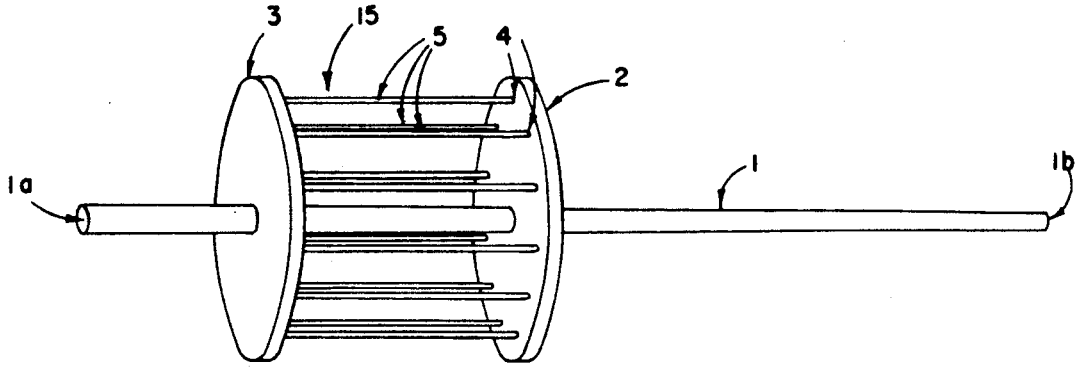
FIG. 1 shows an elevational frontal view of the system of the present invention.

Referring now to FIG. 1, the system of the present invention is shown to be comprised of an elongated tapered rod (1), two relatively large diameter round disks (2) and (3), and a multiplicity of small constant diameter rods (5). The elongated tapered rod is typically 2 feet, 6 inches in length and tapers from ¾ inch in diameter at end (1*a*) to ⅜ inch diameter at end (1*b*). The two relatively large diameter round disks (2) and (3) are typically approximately ¾ inch thick as viewed in elevation when placed on a flat surface, and are typically 9 inches in diameter, (ie. 4.5 inches in radius). One of the relatively large diameter round disks, (3) has a small hole in the center thereof which is typically 0.67 inches in diameter, and the other relatively large diameter round disk (2) has a small hole in the center thereof which is typically 0.54 inches in diameter. When the relatively large diameter round disks are slid over the elongated tapered rod (1) from the small diameter end (1*b*) thereof (3) comes to rest in firm contact with the elongated tapered rod (1) approximately 6 inches from end (1*a*) and (2) comes to rest in firm contact with elongated tapered rod (1) at approximately 1 ft. 3 inches from end (1*b*). The multiplicity of small constant diameter rods (5) are typically 10.5 inches long and they fit into holes (4) in the relatively large diameter round disks along circular loci which have radii of approximately 3.5 inches on the relatively large diameter round disks. The multiplicity of small constant diameter rods each extend into holes (4) in each of the relatively large diameter round disks to a depth of approximately 0.75 inches, hence, the small constant diameter rods also fully transverse the approximately 9 inches which exist between the two relatively large diameter round disks which are positioned on the elongated tapered rod (1) as described above. The multiplicity of small constant diameter rods (5) then seen then in FIG. 1, to form an open cylindrical reel (15) which is approximately 7 inches in diameter.

In use, a kite flyer loosely holds the ends (1*a*) and (1*b*) of the elongated tapered rod (1) in closed areas of his or her hands, which closed areas are formed by touching the thumb to the first finger of each hand. A user, by then causing his or her hands to move in large circular motions, approximately 180 degrees out of phase with one another can cause the elongated tapered rod (1) and attached open cylindrical reel (15), formed as described above, to rotate. If a string (identified as (10) in FIGS. 2, 3A and 3B), is attached to the open cylindrical reel (15) it can be thereby caused to be wound evenly onto, or unwound from, the open cylindrical reel (15), depending on the direction, (i.e. clockwise or counterclockwise), in which the hands are caused to move, and the direction in which the string (10) is wound onto the open cylindrical reel (15) in the first instance. The tapered shape of the elongated tapered rod (1) enhances the effective even distribution of the string (10) as it is wound onto the open cylindrical reel (15). Also, as the string (10) is wound onto an open cylindrical reel (15) which allows air to pass through easily, any moisture which might be absorbed by the string (10) during use can be evaporated.

Figure 2:
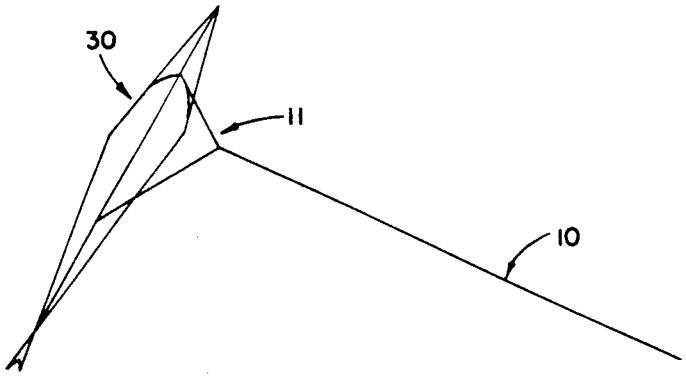
FIG. 2 shows a slightly perspective side elevational view of a typical kite in flight.
Figure 3A:
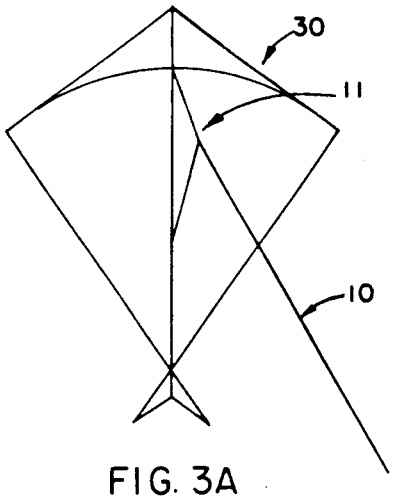
FIGS. 3A and 3B show two slightly perspective frontal elevational views of a kite in flight.
Figure 3B:
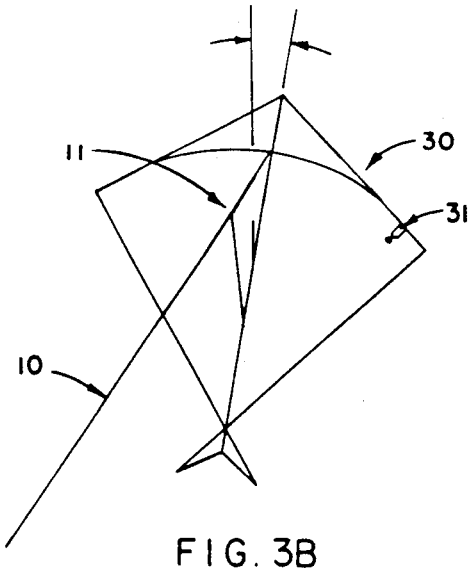

To fly a kite, one must provide a kite (30) with a string (10) attached thereto. Typically the string (10) is attached to a kite with a "V" shape string connection (11), as shown in FIGS. 2 and 3*a* and 3*b*. The demonstrated connection shows the length of the "V" shaped connecting string (11) is commonly shorter at the top portion of the kite (30). The purpose of this configuration is to cause a flying kite to assume, and stay at, an angle to the vertical plane when in flight, as the kite is viewed from the side, as shown in FIG. 2. In said position the wind acts on the kite (30) in a way such that lift and drag forces are created. The string (10) tied to the kite (30) provides a tension generated force which is equal and opposite to the drag force and the weight of the kite (30) acts opposite to the lift force. When the lift force is greater than the weight of the kite (30), the kite (30) rises and gains altitude, and similarly, when the lift force is less than the weight of the kite (30), the kite (30)

looses altitude. Until now, a kite flyer has had to depend upon the wind as a source of lift force. The present invention has overcome that limitation. With the aid of the present invention system, a kite flyer can, from stationary position, and with only a small area available, operate the system as described above to cause string (10) to wind onto the open cylindrical reel (30) quickly enough to generate a significant lift force. One can then allow string (10) to unwind from the open Cylindrical reel (30), then again quickly cause string (10) to again wind onto said open cylindrical reel (30). After a sequence of winding and unwinding cycles a kite (30) will be found to have been launched. This is the case even if the wind is very low at ground level. It is also noted that commonly when the wind at ground level is of a low velocity, wind does exist at higher levels. If one can maneuver the kite (30) to said higher altitudes, it will naturally stay in flight after launching by the described method.

As an added element to enhance the method taught herein, one can attach a weight (31) to a kite (30) such as is shown in FIG. 3B. The purpose of the weight is to cause the kite (30) to assume an angle which is tilted from vertical, as the kite (30) is viewed from the front thereof, during unperturbed constant wind conditions. It has been found that if such a kite (30), with a weight (31) attached is subjected to a quick jerk or tug by way of the attached string, it will "rock". That is it will point in continuously varying directions until a firm constant tension is again developed in the string (10) which is attached to the kite (30). At the instant the firm constant tension is reapplied, the kite (30) will tend to move in the direction in which it was pointed. If one again applies a quick jerk or tug to the string (10), the kite (30) will again rock, and the direction of motion of the kite (30) can be changed from what it was by then reapplying a firm constant tension to the string at an appropriate time. In the described manner, the direction in which a flying kite moves can be controlled. The system of the present invention allows a user to apply all necessary string tensions easily and with precise positive kite (30) control as the focus of his or her efforts.

Some additional considerations are that with many known kite string winding systems it is difficult to wind and unwind string and usage of the systems can cause blisters on one's hands. With the present system, as the ends (1*a*) and (1*b*) of the elongated tapered rod (1) are held loosely, hand blistering is much less likely. As well, as the effective diameter of the open cylindrical reel (15) is much greater than that of the elongated tapered rod (1), an amplification effect is present. That is one rotation of the system as described above, can wind in or unwind a great deal of string (10). As a result, the present system allows very positive control, and that control is not interrupted when string (10) must be wound in or unwound as is the case with systems which require that one tightly grip the element upon which string is wound in order to operate same. In fact, with the present system, winding and unwinding string (10), effected by moving one's hands in large circular motions is the action which effects positive kite (30) launching and flight control, once the kite is launched.

It is also mentioned that the system of the present invention seems to work best when the total weight of the system is in the range of 5 to 15 pounds. That weight range causes an optimum amount of frictional force to develop between the ends (1*a*) and (1*b*) of the elongated tapered rod (1) and a kite flyer's hands when loosely held as described above, and when normal wind velocity levels are present.

Finally, it is emphasized that the dimensions and weights disclosed herein are provided to disclose and describe the preferred embodiment of the present invention system. Said system dimensions and weights are exemplary only, and are not to be interpreted as definitive and thereby limiting.

Having hereby disclosed the subject matter of this invention, it should be obvious that many modifications, substitutions and variations of the present invention are possible in light of the above teachings. It is therefore to be understood that the invention can be practiced other than as specifically described, and should be limited in breadth and scope only by the claims.

I claim:

1. A method for launching and flying kites which comprises the steps of:

a Obtaining a system for use in the flying of kites, which system comprises an elongated tapered rod, two relatively large diameter round disks, and a multiplicity of small constant diameter rods; each said relatively large diameter round disk having a different diameter small hole in the center thereof; which relatively large diameter round disks are secured to the elongated tapered rod by sliding them over the elongated tapered rod from the small diameter end thereof until they naturally and firmly come to rest in contact with the elongated tapered rod with the elongated tapered rod extending laterally beyond both relatively large diameter round disks but extending to a larger extend to the side at the small diameter end of the tapered rod; and which small constant diameter rods are secured between and to the relatively large diameter round disks, along circular loci which are centered at the centers of the relatively large diameter round disks, so that the multiplicity of small constant diameter rods form an open cylindrical reel upon, and from which, string can be wound and unwound;

b obtaining a kite;

c attaching a string from the open cylindrical reel of the system for use in flying kites to the kite, with a significant length of said string being wound onto the open cylindrical reel;

d forming closed areas between the thumbs and first fingers of each hand and loosely placing one end of the elongated tapered rod into one such closed area, and the other end of the elongated tapered rod into the other such area;

e causing ones hand's to perform relatively large circular motions, with the motion of one hand being approximately 180 degrees out of phase with the motion of the other hand, so that the open cylindrical reel is caused to rotate and wind string which is between the open cylindrical reel and the kite onto the open cylindrical reel;

f releasing string from the open cylindrical reel by causing one's hands to move in circular motions as in step e but in opposite directions, and allowing the wind pressure against the flying kite to cause tension induced force in the string and thereby cause string to be wound off the open cylindrical reel; and g repeating steps e and f until the kite is launched.

2. A method for launching and flying kites as in claim 1 which further comprises:

h attaching a weight to the kite prior to launch so that the kite naturally assumes a position tilted from vertical in unperturbed constant wind conditions;

i causing a jerking or tugging tension change to be quickly applied to the string thereby causing the kite to rock and assume varying orientations with respect to a vertical orientation;

j causing a firm relatively constant tension to then be applied to the string when the kite is oriented in the direction in which one wishes the kite to move; and k repeating steps i and j as desired.

* * * * *